United States Patent [19]

Wilson et al.

[11] Patent Number: 4,523,640

[45] Date of Patent: Jun. 18, 1985

[54] ARM RELEASE SYSTEM FOR WELL LOGGING APPARATUS

[75] Inventors: Herbert C. Wilson, Houston; Perumalagaram S. Sankaran, Katy, both of Tex.

[73] Assignee: Dresser Industries, Inc., Dallas, Tex.

[21] Appl. No.: 573,263

[22] Filed: Jan. 23, 1984

[51] Int. Cl.[3] ..... E21B 23/00; E21B 17/10

[52] U.S. Cl. ..... 166/64; 166/241; 33/178 F

[58] Field of Search ..... 166/241, 64, 113, 250; 33/178 F

[56] References Cited

U.S. PATENT DOCUMENTS

| | | | |
|---|---|---|---|
| 2,170,527 | 8/1939 | Culbertson | 33/178 F |
| 2,680,913 | 6/1954 | Johnston et al. | 33/178 F |
| 2,719,361 | 9/1955 | Montgomery et al. | 33/178 F |
| 2,829,441 | 4/1958 | Bagnell | 33/178 F |
| 2,931,440 | 4/1960 | Lebourg | 166/241 |
| 4,425,966 | 1/1984 | Garney | 166/241 |

OTHER PUBLICATIONS

Cerro Sales Corporation–Advertising Brochure.

*Primary Examiner*—Stephen J. Novosad
*Assistant Examiner*—Thuy M. Bui
*Attorney, Agent, or Firm*—Patrick H. McCollum; Richard M. Byron

[57] ABSTRACT

A well logging instrument includes a body member supporting one or more arm members which may be biased outwardly against the sidewalls of the borehole. The arm members may be held in a closed position, adjacent the body member, during entry into a borehole by a heat sensitive retaining member. As the instrument is exposed to borehole temperature the heat sensitive retaining member will within a preselected temperature range release the arm member allowing the arm members to expand outwardly from the body member into contact with the sides of the borehole.

17 Claims, 3 Drawing Figures

ARM RELEASE SYSTEM FOR WELL LOGGING APPARATUS

BACKGROUND OF THE INVENTION

This invention relates generally to well logging apparatus and, more specifically, to methods and apparatus for releasing arm members of a well logging instrument in response to temperature.

It is common in the well logging industry to employ instruments having one or more arm members which can be urged against the borehole walls. Such instruments include, for example, centralizers, having a plurality of arm members which when urged against the borehole walls cause the main body member to be centered in the borehole; calipers, where the expansion of the arm members is translated into a signal indicative of the diameter of the borehole; and various logging instruments, which require one or more measuring elements to be placed in contact with the borehole wall.

Difficulty may occur when lowering such instruments into a borehole with the arm members in an expanded position. Such an operation can result in breakage or excessive wear to the arms. Additionally, when attempting to lower such an instrument with expanded arm members into a deviated borehole the friction of the armborehole wall contact can prevent the instrument from traversing downward into the borehole.

In an effort to overcome these difficulties, prior art in the well logging field has relied on various devices such as motorized actuators, explosive devices and hydraulic solenoid devices. While such devices have met with varying degrees of success they suffer from practical limitations. Motorized actuators add size, weight, cost and complexity to the instrument. Explosive ignitors, such as one used to separate a tensile bar for arm release, are complex, unreliable and unsafe.

Accordingly, the present invention overcomes the deficiencies of the prior art by providing a simple, economical, reliable means for retaining mechanical arm members in a closed position while a well logging instrument is lowered into a borehole and releasing the arm members at an approximate predetermined location within the borehole.

SUMMARY OF THE INVENTION

A well logging instrument for use in a borehole includes an elongated body member supporting one or more contact arm members which may be forced against the borehole sidewalls. The contact arm members are bridgingly supported between a pair of arm carriers, at least one of which is longitudinally slidable on the elongated body members. A coil spring acts upon a slidable arm carrier to bias the contact arms out and against the sides of the borehole.

To aid the instrument in downward traversal into the borehole the contact arm members are held in a closed position by one or more heat sensitive plug members inserted in the slidable arm carrier with a portion thereof extending into the elongated body member. The plug member is constructed of a eutetic alloy such as a bismuth alloy. As the instrument is exposed to borehole temperature within a preselected temperature range the plug will begin to melt and be sheared by the sliding arm carrier allowing the arms to expand outwardly into contact with the sides of the borehole.

BRIEF DESCRIPTON OF THE INVENTION.

DETAILED DESCRIPTION OF A PREFERRED EMBODIMENT

Well logging devices having one or more arm members are common in the industry. For the purposes of this description the present invention will be described in conjunction with a centralizer instrument, although it is contemplated that the present invention has equal utility in conjunction with other well logging instruments having outwardly biased arm members.

Figure 1:
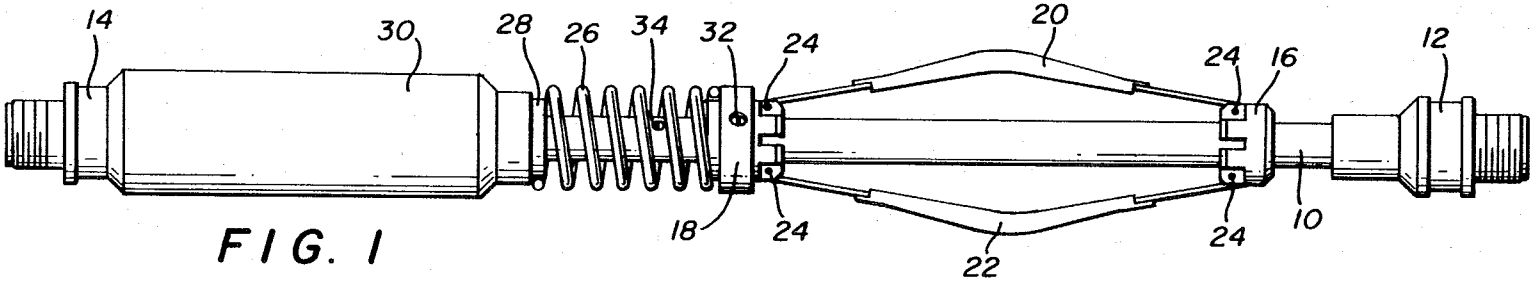
FIG. 1 shows a borehole centralizer instrument of the present invention.

Referring now to the drawings, particularly to FIG. 1, there is illustrated a borehole centralizer instrument. The centralizer has an elongated shaft member 10 with threadable connectors 12 and 14 located at each end thereof so as to allow the centralizer to connected to a well logging cable and/or in combination, above or below, various other well logging instruments. If desired, shaft 10 may have a longitudinal passage therethrough containing one or more electrical conductors for passing electrical signals through the centralizer.

Disposed on shaft 10 are first and second contact arm carriers 16 and 18, respectively. In the illustrated embodiment arm carrier 16 is rigidly fixed to shaft 10 to prevent slidable or rotatable movement thereon while arm carrier 18 is slidably mounted on shaft 10. It should be recognized that the present invention is equally applicable where both arm carriers are slidably mounted on shaft 10. A plurality of contact arms, illustrated by arms 20 and 22, are bridgingly supported between arm carriers 16 and 18. In the illustrated embodiment four arm members in radially spaced apart symmetrical relationship are pivotally attached to arm carriers 16 and 18 at pivot points, illustrated at 24. However, four arm members are for illustrative purposes only, whereas the present invention is equally applicable to an instrument having one or more arm members.

Disposed about shaft 10 is biasing member 26, which is preferrably a helical compression spring. In the preferred design, spring 26 exerts a load force of approximately 270 pounds when compressed. One end of coil spring 26 engages shoulder 28 formed at the lower terminus of section 30 of the caliper member. The second end of coil spring 26 engages a shoulder located on arm carrier 18. Coil spring 26 exerts a force on arm carrier 18 pushing the arm carrier toward the center of shaft member 10, forcing the arm members 20 and 22, and the other arm members not illustrated, diagonally away from the shaft member 10 so that the arm members can contact the sides of the borehole.

As discussed previously, it is often desirable to secure the arm members in a closed position during entry into a borehole while providing a means for opening or releasing the arm members when the instrument is located at an approximate location within the well. The present invention accomplishes this without complex mechanical devices or dangerous explosives.

Figure 2:
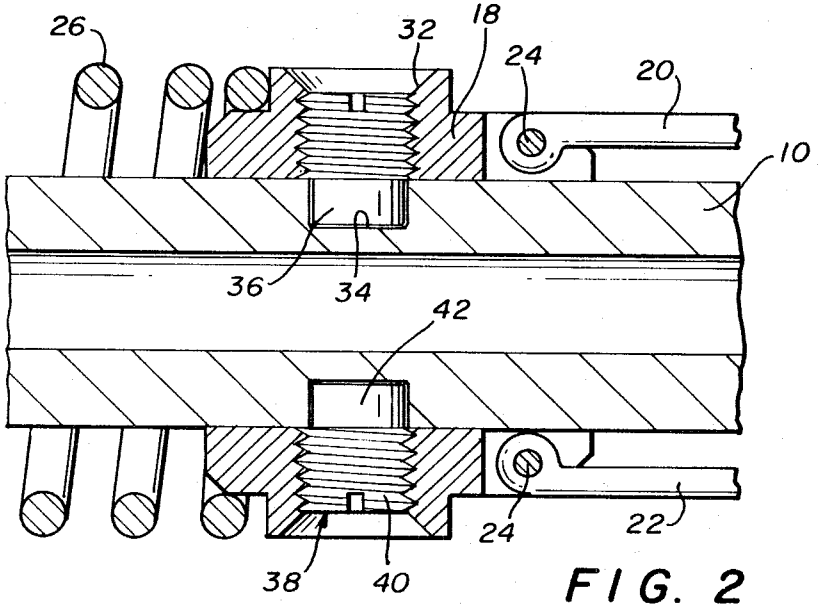
FIG. 2 shows an enlarged portion of the present invention

Prior to placing the instrument into a borehole arm carrier 18 is moved along shaft member 10 compressing spring member 26 and placing in registry aperture 32, located in arm carrier 18, and aperture 34, located in shaft member 10. Referring now to FIG. 2 there is illustrated a sectional view of this portion of the instrument when the arm members are in a closed position. Arm carrier 18 is located on shaft member 10 so that apertures 32 and 34 are aligned, the arm members being in a closed position. Threadably engaged in aperture 32 of arm carrier 18, and having a portion thereof extend into aperture 34 within shaft member 10, is a heat sensitive plug member 36. A second heat sensitive plug member 38 is illustrated on the opposite side of arm carrier 18 extending into a second aperture in shaft member 10.

The heat sensitive plug members, illustrated by plug members 36 and 38, are constructed of bismuth alloys having selected melting temperature characteristics. For example, in the preferred embodiment heat sensitive plug members 36 and 38 are constructed having composition comprising 55.5 percent bismuth with 44.5 percent lead, and/or 58.0 percent bismuth with 42.0 percent tin. The number of heat sensitive plug members used and composition of the bismuth alloy chosen for the plug members are selected to cause the members to shear at approximately a preselected location within the borehole having approximately a preselected temperature, allowing the arm carrier 18 be biased toward the center of shaft member 10, further allowing the arm members to move away from shaft member 10 into contact with the sides of the borehole.

Laboratory tests were conducted to determine the shear temperature for various designs of heat sensitive plug members under varying load conditions. Test data is summarized as follows:

| composition | # plugs used | medium in which tested | load (in lbs) | shear temp (°C.) |
|---|---|---|---|---|
| 58/42 | 2 | oil | 270 | 113.0 |
| 58/42 | 2 | air | 440 | 92.5 |
| 55.5/44.5 | 2 | oil | 270 | 89.0 |
| 58/42 | 1 | oil | 270 | 95.5 |

In the preferred design of the instrument using a coil spring with 270 pounds of load the heat sensitive plug members, are for example, constructed having a ½–20 threaded section 40, approximately 0.625 inches in length, with an unthreaded tang section 42 having a diameter of 0.430 inches and being 0.3125 inches in length. Utilizing heat sensitive plug members of this physical size, to allow the arm members to be released at approximately 89° C. two heat sensitive plugs of a composition of 55.5 percent bismuth and 44.5 percent lead would be used. For a release at an approximate temperature of 95.5° C. one heat sensitive plug of a composition of 58 percent bismuth and 42 percent tin would be used. Two heat sensitive plugs having a 58/42 percent composition would be used for an approximate release temperature of 113° C. It is contemplated that the release temperature have a tolerance within approximately ±10° C.

In the operation of the instrument, the arm members 20 and 22, are closed against shaft member 10. The desired opening temperature is selected and the heat sensitive plug members having temperature characteristics within a range of the desired are selected and threadably installed in arm carrier 18 a portion thereof extending into shaft member 10. The instrument is lowered into a borehole. At approximately the preselected temperature within the borehole the heat sensitive plug members will begin to melt and the load force exerted by spring 26 on arm carrier 18 will cause the plugs, 36 and 38 for example, to shear thereby releasing arm carrier 18 and expanding the arm members, 20 and 22.

Figure 3:
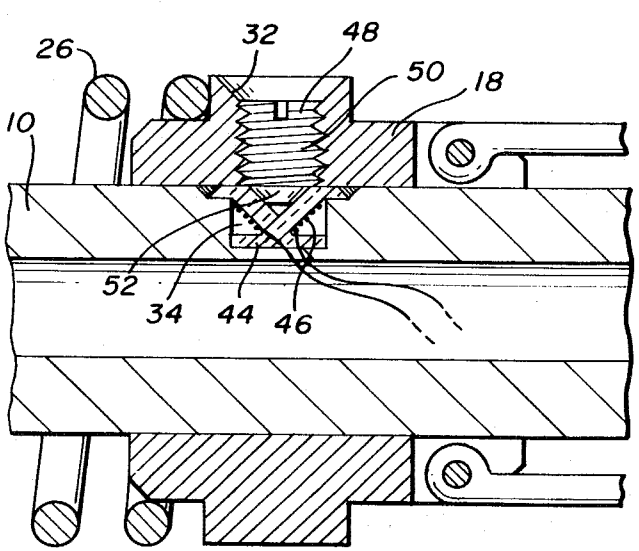
FIG. 3 shows an alternated embodiment of the invention.

FIG. 3 illustrates an alternate embodiment of the present invention. In this embodiment aperture 34 in shaft member 10 is fitted with a heater coil assembly. The heater coil assembly includes an insert 44 or bobbin having a heater winding 46 of nicrome wire thereabout. Heater winding 46 is connected to a suitable power source (not illustrated). Heat sensitive plug 48 has a threaded section 50 for insertion into aperture 32 in arm carrier 18 and a truncated tapered portion 52 which when fully inserted extends into a complimentary tapered cavity in insert 44.

In the operation of this alternative embodiment heating current is supplied from a power source to heater coil winding 46. The heating of the coil causes heat sensitive plug 48 to begin to melt. The force exerted by spring 26 will cause plug 48 to shear resulting in release of arm carrier 18 and expansion of the arm members as described previously. By using the embodiment of FIG. 3 the operation of the opening system is not limited to borehole temperature. Therefore, the opening of the arm system is a function of the heating temperature of the heater winding. It should be recognized that while only one such heating element is illustrated in FIG. 3 more than one such assemblies could be used if desired.

While a particular embodiment of the present invention has been described, it will be apparant to those skilled in the art that changes and modifications may be made without departing from this invention in its broader aspects. Accordingly, it should be clearly understood that the form of the invention described and illustrated herein is exemplary only, and is not intended as a limitation on the scope of the present invention.

The embodiments of the invention in which an exclusive property or privelege is claimed are defined as follows:

1. A well logging apparatus, comprising:

an elongated body member adopted to traverse a borehole;

at least one arm member pivotally attached to said body member;

means for biasing said arm member outwardly with respect to said body member; and temperature responsive means for restraining said arm member in a closed position during entry into said borehole.

2. The well logging apparatus of claim 1 wherein said temperature responsive means comprises means for releasing said arm member for outward exansion at an approximate predetermined temperature.

3. The well logging apparatus of claim 2 wherein said temperature responsive restraining means comprises at least one eutectic alloy member.

4. The well logging apparatus of claim 3 wherein said eutectic alloy member comprises a bismuth alloy member.

5. The well logging apparatus of claim 4 wherein said bismuth alloy member comprises bismuth and lead.

6. The well logging apparatus of claim 5 wherein said bismuth alloy member comprises 55.5 percent bismuth and 44.5 percent lead.

7. The well logging apparatus of claim 4 wherein said bismuth alloy member comprises bismuth and tin.

8. The well logging apparatus of claim 7 wherein said bismuth alloy member comprises 58 percent bismuth and 42 percent tin.

9. A well logging apparatus, comprising:

an elongated body member adapted to traverse a borehole;

an arm carrier member slidably mounted on said body member for longitudinal movement thereon;

a plurality of arm members mounted to said arm carrier member;

biasing means for reseliently biasing said arm carrier to move said arm members outwardly with respect to said body member; and means for restraining said arm members in a closed position and releasing said arm members to an outwardly expanded position in response to temperature.

10. The well logging apparatus of claim 9 wherein said restraining means comprises at least one threaded member threadably engaged in and extending through said first arm carrier member and engagable with said body member.

11. The well logging apparatus of claim 10 wherein said threaded member comprises an eutectic alloy member.

12. The well logging apparatus of claim 11 wherein said eutectic alloy member comprises a bismuth alloy member.

13. The well logging apparatus of claim 12 wherein said bismuth alloy member comprises bismuth and lead.

14. The well logging apparatus of claim 13 wherein said bismuth alloy member comprises 55.5 percent bismuth and 44.5 percent lead.

15. The well logging apparatus of claim 12 wherein said bismuth alloy member comprises bismuth and tin.

16. The well logging apparatus of claim 15 wherein said bismuth alloy member comprises 58 percent bismuth and 42 percent tin.

17. The well logging apparatus of claim 9 further comprising means for heating said restraining means to a predetermined temperature.

* * * * *